US007157721B1

(12) United States Patent
Blanchard

(10) Patent No.: US 7,157,721 B1
(45) Date of Patent: Jan. 2, 2007

(54) COUPLED IONIZATION APPARATUS AND METHODS

(75) Inventor: William C. Blanchard, Phoenix, MD (US)

(73) Assignee: Transducer Technology, Inc., Newark, CA (US)

( * ) Notice: Subject to any disclaimer, the term of this patent is extended or adjusted under 35 U.S.C. 154(b) by 12 days.

(21) Appl. No.: 11/018,191

(22) Filed: Dec. 21, 2004

Related U.S. Application Data

(60) Provisional application No. 60/531,768, filed on Dec. 22, 2003.

(51) Int. Cl.
*H01J 49/40* (2006.01)
*H01J 49/10* (2006.01)
*H01J 49/26* (2006.01)

(52) U.S. Cl. ..... 250/423 R; 250/288; 250/424; 315/111.81; 315/111.21

(58) Field of Classification Search ..... 250/288
See application file for complete search history.

(56) References Cited

U.S. PATENT DOCUMENTS

2003/0070913 A1* 4/2003 Miller et al. ..... 204/192.1

FOREIGN PATENT DOCUMENTS

JP 07-071947 3/1995
JP 2004-251682 9/2004

* cited by examiner

*Primary Examiner*—Nikita Wells
*Assistant Examiner*—James J. Leybourne
(74) *Attorney, Agent, or Firm*—Dinsmore & Shohl LLP

(57) ABSTRACT

Apparatus for generating ions in a gaseous medium, the apparatus including two electrodes separated by a dielectric material and a means for generating radio frequency pulses. The electrodes are of dissimilar size and are attached to opposite sides of the dielectric material. The smaller electrode shape and circumference is configured to control the quantity of plasma that is produced. Method of generating ions in a gaseous medium having the step of applying a radio frequency voltage between two electrodes separated by a dielectric material so as to generate a plasma ion source. Locating the plasma ion source in a confined area to yield NO3-ions. Locating the plasma ion source in an open configuration to yield predominantly CO3-ions with minor amounts of O2- and O3-ions.

21 Claims, 6 Drawing Sheets

COUPLED IONIZATION APPARATUS AND METHODS

REFERENCE TO RELATED APPLICATIONS

This is a continuation in part of Provisional Application Ser. No. 60/531,768, filed 22 Dec. 2003.

BACKGROUND OF THE INVENTION

This invention pertains to methods and apparatus for using the polarity reversals of a confined plasma, or similar electrode on one side of a dielectric, to generate useful ions and ionized molecules with a plasma around an electrode external to the confining dielectric, thus, being a plasma Ion Source; and a method and apparatus for the separation of these ions and molecules according to their polarity by use of an electric field; and a method and apparatus to couple or make available the selected polarity of the separated ions and molecules to a detection system. Thus, these Coupled Ionization Apparatus and Methods provide a novel ionizer and the techniques for interfacing the ionizer to chemical detection systems. Among detection systems that could be attached to and use this ion generator are, but not limited to: Ion Mobility Spectrometer [IMS]; Ion Barrier Mobility Spectrometer [IBMS]; ion capture smoke/particle detector; Particle Mobility Spectrometer; ion or particle differential mobility analyzer using DC electric fields; ion or particle differential mobility analyzer using asymmetrical radio frequency [RF] fields, and; reduced pressure mass detectors, such as a Mass Spectrometer.

One of the objectives of this novel ionization technique is to suppress point-to-point corona ionization. Its purpose is to minimize direct streamers normally generated by conventional point-to-plane corona discharge ionization sources and increase the quantity of pre-arc glow discharge ionization. It is similar to corona but without the corona point erosion and instability leading to a short ion source lifetime. Only the quantity of ions that will satisfy the required system signal-to-noise ratio should be generated using this technique. As the energy to the plasma ion source is increased, the ions generated outside the dielectric also increase in numbers, and they become more energetic. At very high ion source energy levels more corona and less glow discharge will occur and negative ions of ozone (O3—) and nitrous oxides (NOX—) will be produced. Also, when an electrode is separated from the dielectric, corona can occur. There are no apparent changes in the ions produced in the positive mode. This is typical of corona ionization.

It is an object of this invention to replace point-to-point corona discharge by an ion source that includes design configuration flexibility.

It is another object of this invention to replace point-to-point corona discharge by an ion source that includes dimensional stability.

It is yet another object of this invention to replace point-to-point corona discharge by an ion source that includes simplicity and ruggedness of design.

It is yet a further object of this invention to replace point-to-point corona discharge by an ion source that includes extended source lifetime.

More objects of the invention will become apparent to professionals in the chemical and biological defense, law enforcement, health monitoring, disease control, industrial safety and hygiene, environmental, chemical, metallurgical, and related areas following perusal of the complete specification

SUMMARY OF THE INVENTION

Briefly, the invention consists of providing a new distributed plasma ion source as an alternative to point-to-point corona or radioactive ionization sources in ion detection and/or classification instruments. The plasma ion source operates at atmospheric pressure by placing a high RF voltage across two overlapping electrodes separated by a dielectric. With two electrodes, preferably of dissimilar size attached to opposite sides of a thin dielectric, a suitable AC high-voltage signal across the electrodes produces a high electric field along the entire edge of the smaller electrode. The high electric field ionizes the gas sample, and creates the resulting plasma. Thus the shape and circumference of the smaller electrode can control the quantity of plasma that is produced. The ionized molecules that are formed are dependent upon the reaction region configuration.

As monitored by a mass spectrometer, several reaction region configurations yield ions that are similar to those generated in a corona discharge. The positive ions that are produced are similar to those generated by 63-Ni, 273-Am, or by a corona discharge. The negative ions produced are similar to those yielded by a point-to-point corona discharge except that the reaction region configuration aids in discriminating between the formation of NO3-, CO3-, and O2-ions. With this ion source located in a confined but not airtight volume, typically 1.in. by ½ in. diameter, reactions lead to the formation of NO3-ions, while an open configuration shows a predominant ion as CO3- with minor ions of O2- and O3-.

We can thus selectively generate ions using high AC voltage pulses and dissimilar sized electrodes in contact with or attached to a dielectric, selectively extract them according to there polarity, discriminate among the resulting ionized molecules and detect them using this novel plasma ion source.

BRIEF DESCRIPTION OF THE DRAWINGS

The invention is best explained with reference to the drawings, in which.

Figure 2:
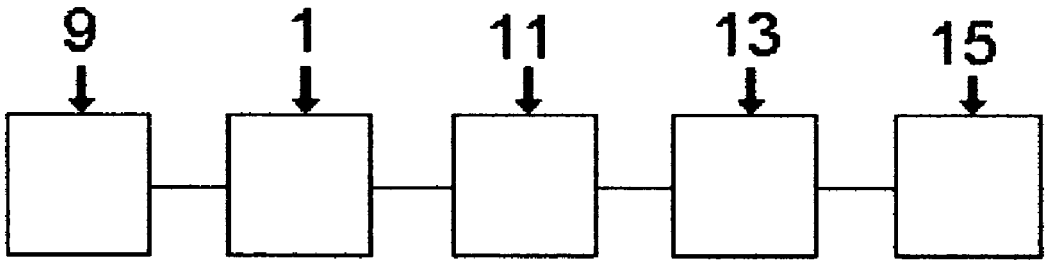
FIG. 2 is a block diagram of a detection system incorporating a plasma Ion Source 1 consisting of the RF Power Supply 9, an ion detector such as a Ion Barrier Mobility Spectrometer (IBMS) 11, a detected ion Preamplifier 13, and an Oscilloscope 15.
Figure 4:
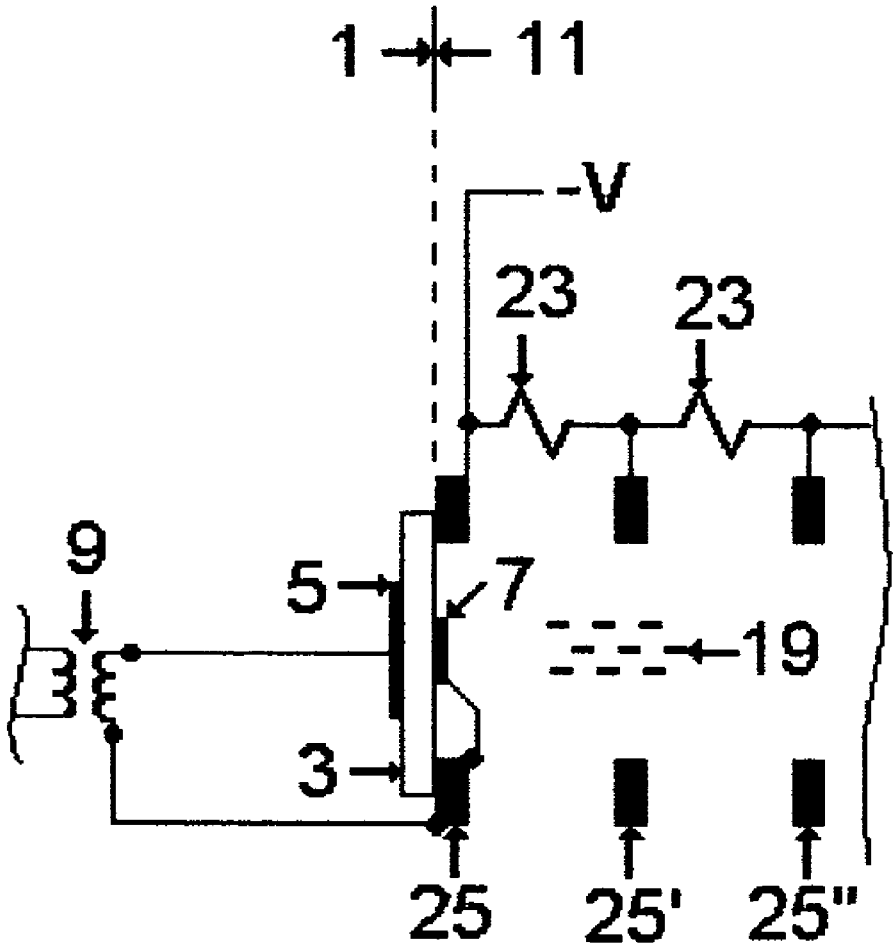
FIG. 4 shows an interface between a plasma Ion Source 1 and an IBMS 11 consisting of; a negative (−V) voltage source, connected in series with Resistors 23 and with ring Electrodes 25, 25' and 25" to generate an electric field inside the IBMS 11, with Small Electrode 7 connected to Electrode 25, and with the Large Electrode 5 and Electrode 25 connected to the RF Power Supply 9. The Negative Ions 19 generated by the Ion Source 1 are shown separated by the electric field and moving into the IBMS 11.
Figure 5:
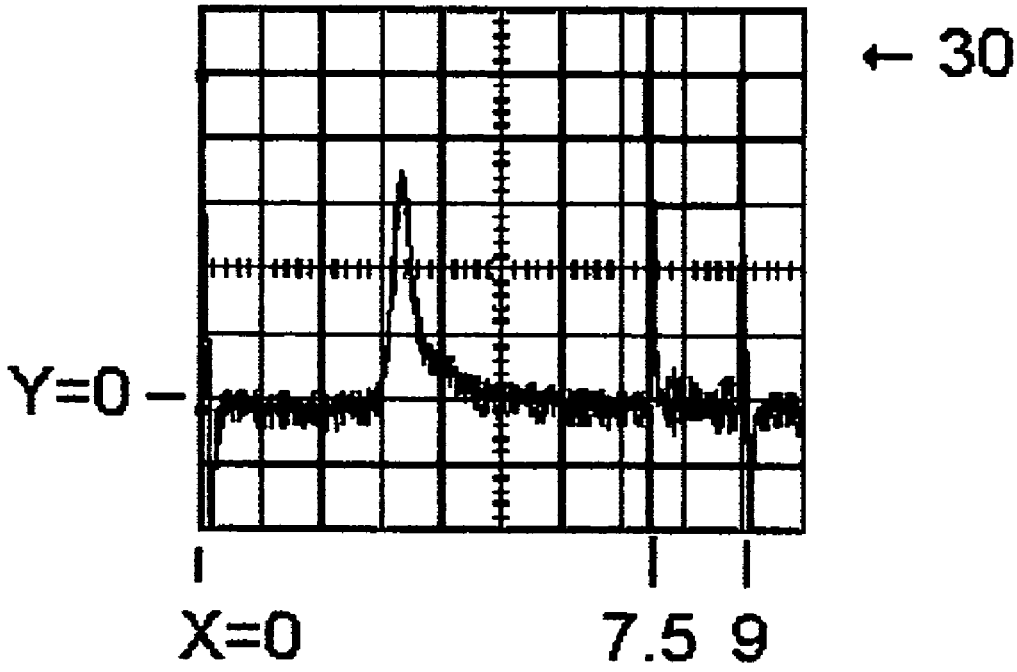

FIG. 5 is the resulting IBMS Signature 30 as it appears on the Oscilloscope 15 of FIG. 2, using the plasma Ion Source 1 and the setup as shown in FIG. 2 and the interface as shown in FIG. 4. The resulting IBMS Signature 30 is shown from X=0 to 7.5 divisions. The ion positioning duration cycle time for the IBMS 11 is shown from X=7.5 to 9 divisions. Note, some easily removable coupling of the RF Waveform 35 has been purposely made visible on this IBMS Signature 30 for reference.

Figure 3:
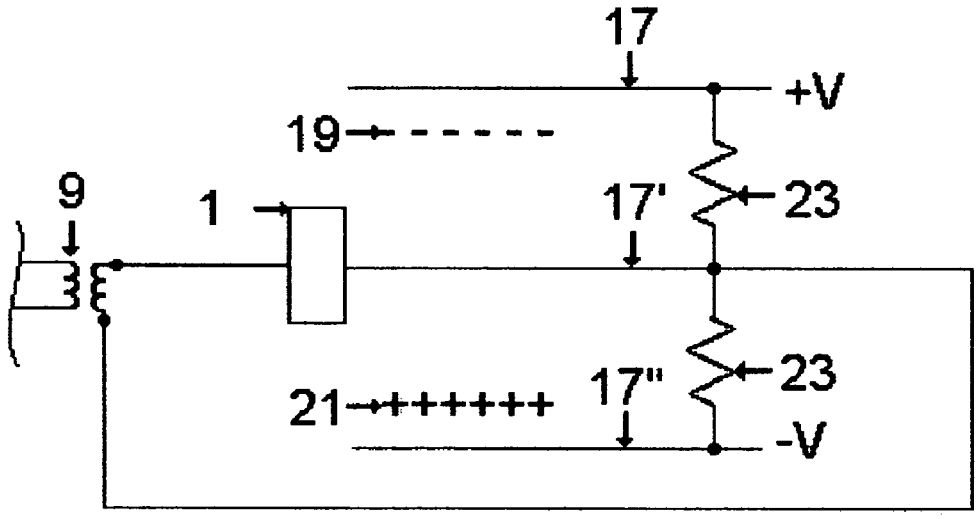
FIG. 3 is the preferred interface between a plasma Ion Source 1 and an ion polarity separating electric field consisting of; a positive (+V) and a negative (−V) voltage source, connected in series using Resistors 23 and with connected Electrodes 17,17' and 17" to generate an electric field between Electrodes 17 and 17", with the Ion Source 1 connected to Electrode 17', with the Ion Source 1 and Electrode 17' connected to the RF Power Supply 9. The Negative Ions 19 and Positive Ions 21 generated by the Ion Source 1 are shown separated by the electric field.
Figure 6:
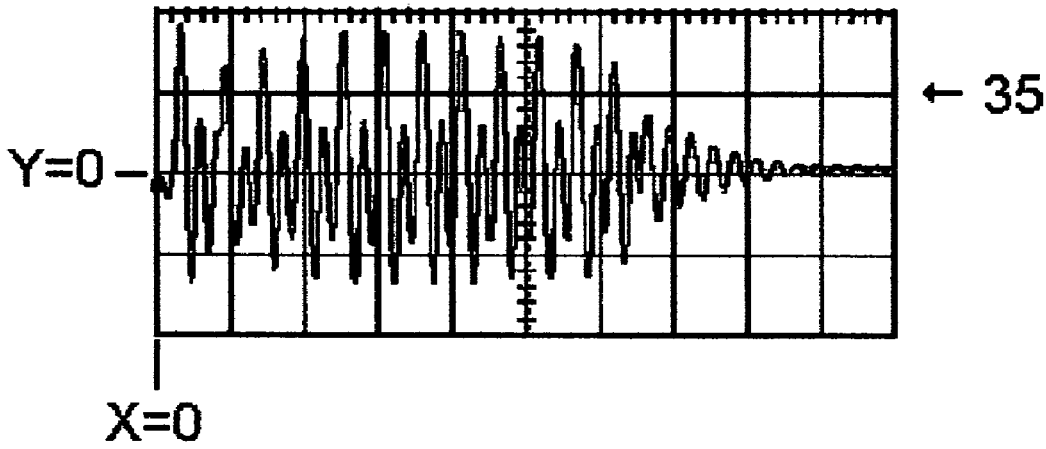

FIG. 6 shows the RF Waveform 35 supplied to the plasma Ion Source 1 from the RF Power Supply 9 in FIGS. 2, 3, and 4. The scale of the RF Waveform 35 is: Y=2.kV/division, X=20 microsec/division.

DETAILED DESCRIPTION OF THE INVENTION

This Coupled Ionization [CI] apparatus consists of a plasma ion source and a method of delivering the ions to a detection system. The ion source operates in the early or pre-corona glow discharge stage of what is normally thought of as Townsend field ionization. There are many requirements for a corona arc discharge, two of which are a sufficiently high electric field, and that this field occur over a sufficient time interval to produce the required quantity of ions. It is the intent of this ion source technique to inhibit corona arc discharges, i.e., that the electric field and its time be minimized such that lower energetic hydrated ions of O2- are created. A glow discharge typically produces $5\times10^{15}$ electrons per cubic meter in air under standard conditions. A glow discharge is produced for a short enough time so that secondary ions such as NOX and Ozone are minimized and ions of O2- are produced.

The preferred ion source physical configuration uses a dielectric between a relatively large electrode and a small electrode. The small electrode is exposed to the media where ions are to be created. Applying a potential between the electrodes produces a relatively large area of dielectric around the small electrode that becomes electrically charged. This charged surface attracts charged particles in the media, and these particles attach to the dielectric in the vicinity of the small electrode. The electric field in this vicinity is sufficient to cause a glow discharge or plasma. By reversing the polarity on the electrodes, the attached ions are repelled from the dielectric surface back into the gas media as a group of singular polarity concentrated ions. A second electric field, located in the media, possibly but not necessarily perpendicularly to the field across the dielectric, maintains this group of concentrated ions of one polarity as a discrete packet of ions and physically moves the ions in a desired direction. In addition, as a result of reversing the polarity of the potential across the dielectric, a new group of charged particles, of opposite polarity to the previously described group, are attracted to the charged dielectric and are attached. This process is repeated several times, but not continuously. This allows the ionization area a chance to clear itself of excess ions that may have been formed, thus inhibiting a corona discharge.

Figure 1:
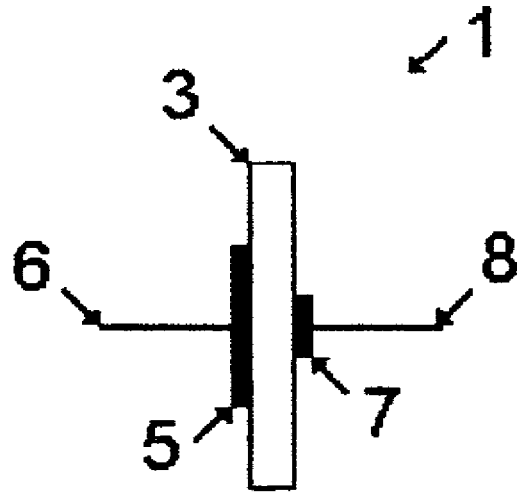
FIG. 1 is a preferred plasma Ion Source 1, consisting of a Dielectric 3, a Large Electrode 5, a Lead to Large Electrode 6 to make electrical contact, a Small Electrode 7, a Lead to Small Electrode 8 to make electrical contact.

Several alternative ion source configurations can be used with the above operational techniques and parameters to produce ions. A neon bulb with both leads connected together can be made to glow by using a RF pulse. This glow is plasma that acts as a conductive surface inside the bulb and acts as an electrode on one side of a dielectric surface. A non-pointed electrode is placed on the bulb to complete the ion source. A pointed electrode will cause a corona discharge. Several configurations of plasma glow bulb and blunt electrode have been operated as ion sources. A small ceramic-coated disk capacitor with both leads connected together and with a blunt electrode attached can also operate as a ion source. In general, the use of conductive materials applied to both sides of a Dielectric 3 like glass or ceramic as shown in FIG. 1 has been found to be repeatable and reliable. It has been further found that when the conductive materials are of dissimilar size, i.e. a Large Electrode 6 and a Small Electrode 7 the ion production is enhanced. Some corona will be formed at the edge of the Small Electrode 7 and therefore its edge material should resist erosion.

The plasma Ion Source 1 is interfaced to a detection system as shown in FIG. 2. The RF Power Supply 9, is electrically connected to both the Ion Source 1 Lead to Large Electrode 6, shown in FIG. 1, and to a Electrode 25 of the IBMS 11, shown in FIG. 4. The IBMS 11 supplies the sync signal that is connected to the Oscilloscope 15.

The charged particles on the outside surface of the Ion Source 1 are expelled from the surface by the change of polarity of the plasma. A DC-generated electric field, typically 200 v/cm., is created outside the Ion Source 1, and the expelled charged particles will separate when they move away from the surface of the dielectric, according to their polarity as shown in FIG. 3. The Negative Ions 19 move in the direction of increasing field potential, and the Positive Ions 21 move in the direction of decreasing field potential. It has been found that the exterior of the Ion Source 1 should be electrically referenced to an electrode of the DC electric field, such as Electrode 17'.

The shape of the chamber containing the DC electric field effects the resulting ionized molecules. A chamber where the side walls are open is usually desired and produces ions as previously describer. A chamber where the side walls are enclosed will produce more NO3-ions that have been shown to cluster with explosives.

The plasma Ion Source 1 has been interfaced to an IBMS 11. The IBMS 11 is described in proceedings of the Int. Symposium for Ion Mobility Spectrometry, Aug. 4, 1999.

Details of the actual interface of the plasma Ion Source 1 with an IBMS 11 are shown in FIG. 4. The IBMS 11 was operated in negative mode with ambient air. The resulting IBMS Signature 30 is shown in FIG. 5 X=0.0 to 7.5. The X=7.5 to 9 trace is the ion positioning duration of the IBMS 11. Some coupling of the RF pulse from the RF Power Supply 9 is shown on the signature for reference.

The RF Power Supply 9 output is transformer coupled and connected to the Lead to Large Electrode 6 of the plasma Ion Source 1 and to the Ring Electrode 25 of the IBMS 11. The frequency and duration of the energy source is typically 5 to 20 cycles of a 50 to 500 kHz pulse. The amplitude of the pulse is typically 1 to 5 kV/pulse. Longer pulses of RF produce undesired ion chemistries. The pulse repetition rate can be varied such that the desired quantity of ions are accumulated, thus controlling the detection system signal to noise ratio. Typically a 5 to 20% duty rate is adequate. The RF Waveform 35 is shown in FIG. 6.

EXPERIMENTAL EXAMPLES

An RF voltage was placed across two electrodes separated by a dielectric (glass slide) to create the new plasma ion source. Several configurations were investigated and two seemed to work better than the rest. These plasma ion sources were placed in front of a mass spectrometer to study the ions produced. The open plasma ion source was then monitored over time to investigate long term stability. The enclosed plasma ion source was interfaced to the mass spectrometer and explosives were introduced to study ion formation with different reactant ions.

Each open plasma ion source was a glass slide with a large and small electrode drawn on either side with a silver conductive pen. The small electrode was coated with hydrogen hexachloroplatinate (IV) to provide a platinum coating. Another slide had no coating. After 17 hours of use, discoloration could be seen around the edge of the uncoated smaller electrode where it was glowing. Both sources were run for approximately 80 hours each. The coated small electrode exhibited no sign of deterioration.

The enclosed plasma ion source is a glass slide encased in a Teflon cylinder, approximately ½ in diameter by 1 in. long. The slide has a small hole to allow air to flow through it and for sample introduction. This enclosed plasma ion source produced different negative reactant ions than the open source.

Mass spectra of both the coated and uncoated open plasma ion source designs and a conventional open Corona Ion Source exhibited similar negative ions with a main peak of 60 amu that was CO3- with minor ions of O2- and O3- at 32 and 48 amu respectively. The enclosed plasma ion source created a mass spectrum with 62 and 125 amu as the main peaks. Fragmentation of the 62 peak showed that it was NO3- with daughter ions of O2- (32) and NO2- (46). Fragmentation of the 125 peak showed a loss of 63 to create the 62 ion, which may be associated with an NO3(HNO3)- cluster.

Vapors of the explosive RDX (Molecular wt. 222) yielded the following peaks and associated compositions with the enclosed plasma ion source (NO3-reactant ions):

| Peak | Composition |
|---|---|
| 62 | NO3— |
| 257 | RDX + Cl— |
| 284 | RDX + NO3— |

In comparison, RDX with a standard commercial corona (CO3-reactant ions) yielded the following peaks and associated compositions:

| Peak | Composition |
|---|---|
| 32 | O2— |
| 46 | NO2— |
| 60 | CO3— |
| 77 | Unknown |
| 257 | RDX + Cl— |
| 268 | RDX + NO2— |
| 282 | RDX + CO3— |
| 299 | RDX + 77 |

Whereas the commercial corona spectrum shows multiple small cluster peaks, the spectrum from the closed plasma ion source is much cleaner and has two large peaks, the largest of which is the RDX(NO3—) cluster.

Similarly, with nitroglycerin[NG] vapor (Molecular wt. 227), the enclosed plasma ion source (NO3-reactant ions) yielded the following peaks:

| Peak | Composition |
|---|---|
| 62 | NO3— |
| 125 | NO3—(HNO3) |
| 141 | Unknown |
| 262 | NG + Cl— |
| 289 | NG + NO3— |

In comparison, the following peaks were obtained for NG with standard corona (CO3-reactant ions):

| Peak | Composition |
|---|---|
| 32 | O2— |
| 46 | NO2— |
| 60 | CO3— |
| 62 | NO3— |
| 77 | Unknown |
| 262 | NG + Cl— |
| 273 | NG + NO2— |
| 287 | NG + CO3— |
| 289 | NG + NO3— |
| 304 | NG + 77 |

NG can thus be seen to behave similarly to the RDX. The commercial corona spectra still have many small cluster peaks, whereas the closed plasma ion source shows fewer peaks with the largest being that of NG(NO3—).

It has thus been shown that the disclosed novel plasma ion sources can replace or supplement the conventional sources in IMS and mass spectrometry. The open plasma ion source gives off ions similar to standard point-to-plane corona discharge ionization. The enclosed plasma ion source produces NO3- as its main ion. The NO3-ion created with the enclosed plasma ion source was shown to cluster well with explosives such as RDX, PETN and NG. The new plasma ion source may provide a simple, more rugged design than either needles or fine wire.

There will now be obvious many variations and modifications of the afore-disclosed embodiments to persons skilled in the art. All of these variations and modifications will remain within the scope of this invention if defined by the following claims.

The invention claimed is:

1. Apparatus for generating ions in a gaseous medium which comprises two electrodes separated by a dielectric material and means for generating radio frequency pulses, said apparatus constituting a plasma ion source; and wherein said electrodes are of dissimilar size and are attached to opposite sides of the dielectric material.

2. The apparatus of claim 1, wherein said ion source is incorporated in or attached to an ion mobility spectrometer or another atmospheric ion detection and/or classification instrument, including but not limited to: Ion Barrier Mobility Spectrometer; ion capture smoke/particle detector; Particle Mobility Spectrometer; ion or particle differential mobility analyzer using DC electric fields; ion or particle differential mobility analyzer using asymmetrical radio frequency [RF] fields, and; reduced pressure mass detectors, such as a Mass Spectrometer.

3. The apparatus of claim 1, comprising means for separating said ions according to their polarity by an electric field.

4. The apparatus of claim 3, wherein said separated ions of selected polarity are made available to a detection system.

5. The Apparatus of claim 1, wherein one of the electrodes edges is offset from the other electrode edge.

6. A method of generating ions in a gaseous medium comprising the step of applying a radio frequency voltage between two electrodes separated by a dielectric material so as to generate a plasma ion source; wherein the two electrodes are of dissimilar size and are attached to opposite sides of the dielectric material.

7. The method of claim 6, wherein said radio frequency voltage is high enough and otherwise suitable to produce plasma along the edge of the smaller electrode.

8. The method of claim 6 which comprises locating the source in a confined area so as to generate NO3-ions.

9. The method of claim 6, which comprises an open source configuration yielding predominately CO3-ions with minor amounts of O2- and O3-ions.

10. The method of claim 6 which comprises the step of separating said ions according to their polarity by an electric field.

11. The method of claim 10, which comprises the further step of making said separated ions of selected polarity available to a detection system.

12. The method of claim 6, further comprising:

applying a high electric potential across the electrodes, such as to produce an electric field in the dielectric material.

13. The method of claim 12, wherein the high electric potential comprises an AC pulse having a frequency range of several hundred Hertz.

14. The method of claim 13, further comprising an interface region between the two electrodes, and wherein the high electric potential is configured such that the electric field at the interface region causes an ionizable gas to ionize thus producing a plasma of ions.

15. The method of claim 14, further comprising:

providing an additional electrode; and applying a DC electric field between the additional electrode and the plasma ion source.

16. The method of claim 15, further comprising extracting ions from the surface of the plasma.

17. A method of generating ions in a gaseous medium comprising the step of applying a radio frequency voltage between two electrodes separated by a dielectric material so as to generate a plasma ion source; and wherein the two electrodes are of dissimilar size attached to opposite sides of a thin dielectric and wherein the shape and circumference of the smaller electrode controls the quantity of plasma that is produced.

18. The method of claim 17, wherein said radio frequency voltage is high enough and otherwise suitable to produce plasma along the edge of the smaller electrode.

19. A method of generating ions in a gaseous medium comprising the steps of:

applying a radio frequency voltage between two electrodes separated by a dielectric material so as to generate a plasma ion source; and locating the plasma ion source in a confined area so as to generate NO3-ions.

20. A method of generating ions in a gaseous medium comprising the steps of:

applying a radio frequency voltage between two electrodes separated by a dielectric material so as to generate a plasma ion source; and locating the plasma ion source in an open source configuration yielding predominately CO3-ions with minor amounts of O2- and O3-ions.

21. Apparatus for generating ions in a gaseous medium which comprises two electrodes separated by a dielectric material and means for generating a time-dependent signal, said apparatus constituting a plasma ion source; and wherein said electrodes are placed on opposite sides of the dielectric material and wherein the dielectric material is thin and flat.

* * * * *